US006900773B2

(12) United States Patent
Poilasne et al.

(10) Patent No.: US 6,900,773 B2
(45) Date of Patent: May 31, 2005

(54) ACTIVE CONFIGURABLE CAPACITIVELY LOADED MAGNETIC DIPLOE

(75) Inventors: Gregory Poilasne, San Diego, CA (US); Laurent Desclos, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 106 days.

(21) Appl. No.: 10/298,870

(22) Filed: Nov. 18, 2002

(65) Prior Publication Data

US 2004/0095280 A1 May 20, 2004

(51) Int. Cl.[7] ..... H01Q 9/28
(52) U.S. Cl. ..... 343/795; 343/804; 343/744

(58) Field of Search ..... 343/702, 793, 343/795, 803, 804, 829, 830, 741, 744

(56) References Cited

U.S. PATENT DOCUMENTS 3,827,053 A * 7/1974 Willie et al. ..... 343/701
5,936,590 A * 8/1999 Funder ..... 343/795
6,008,764 A * 12/1999 Ollikainen et al. .. 343/700 MS
6,366,258 B2 * 4/2002 Reece et al. ..... 343/816
6,529,749 B1 * 3/2003 Hayes et al. ..... 455/575.7

* cited by examiner

*Primary Examiner*—Shih-Chao Chen
(74) *Attorney, Agent, or Firm*—Foley & Lardner LLP

(57) ABSTRACT

A capacitively coupled dipole antenna is provided with one or more active control elements. The active control elements may be used to effectuate changes in the operating characteristics of the antenna.

27 Claims, 10 Drawing Sheets

*Side-View*

*Side-View*

*Side-View*

*Side-View*

*Side-View*

*Side-View*

*Top-View*

*Top-View*

*Side-View*

*Side-View*

ACTIVE CONFIGURABLE CAPACITIVELY LOADED MAGNETIC DIPLOE

CROSS-REFERENCE TO RELATED APPLICATIONS

This application relates to application Ser. No. 09/982,928, filed on Jun. 26, 2001, corresponding to U.S. Pat. No. 6,456,243 issued on Sep. 24, 2002, entitled "Multi Frequency Magnetic Dipole Antenna Structures and Methods of Reusing the Volume of an Antenna" by L. Desclos, et al., commonly owned by the assignee of this application and incorporated herein by reference.

This application relates to co-pending application Ser. No. 10/322,196, filed on Dec. 17, 2002, entitled "M-Series Capacitively Loaded Magnetic Dipole, Implementation, Improvement and Manufacturing" by V. Pathak et al., owned by the assignee of this application.

This application relates to co-pending application Ser. No. 10/133,717, filed Apr. 25, 2002, entitled "Low-Profile, Multi-Frequency, Multi-Band, Capacitively Loaded Magnetic Dipole Antenna" by G. Poilasne et al., commonly owned by the assignee of this application and incorporated herein by reference.

FIELD OF THE INVENTION

The present invention relates generally to the field of wireless communications and devices, and more particularly to the design of active configurable capacitively loaded magnetic dipole antennas.

BACKGROUND

As new generations of handsets and other wireless communication devices become smaller and embedded with more and more applications, new antenna designs will be needed to provide solutions to inherent limitations of these devices. With classical antenna structures, a certain physical volume is required to produce a resonant antenna structure at a particular radio frequency and with a particular bandwidth. In multi-band applications, more than one such resonant antenna structure may be required. With the advent of a new generation of wireless devices, such classical antenna structures will need to take into account beam switching, beam steering, space or polarization antenna diversity, impedance matching, frequency switching, mode switching, etc, in order to reduce the size of devices and improve their performance. The present invention addresses the need for improvement of prior antenna designs by addressing one or more of their limitations.

SUMMARY OF THE INVENTION

The present invention includes one or more embodiment of an active configurable capacitively loaded magnetic dipole antenna.

In one embodiment, a device comprises a plurality of portions, the plurality of portions coupled to define a capacitively loaded dipole antenna; and at least one active control element, wherein the at least one control element is electrically coupled to one or more of the portions. One or more of the plurality of portions may define a capacitive area, wherein at least one control element is disposed generally in the capacitive area. One or more of the plurality of portions may define an inductive area, wherein at least one control element is disposed generally in the inductive area. One or more of the plurality of portions may define a feed area, wherein at least one control element is disposed generally in the feed area. The plurality of portions may comprise a top portion, a middle portion, a bottom portion; wherein the top portion is coupled to the bottom portion; wherein the bottom portion is coupled to the middle portion, and wherein the middle portion is disposed generally between the top portion and the bottom portion. The top portion and the middle portion may define a capacitive area, wherein the middle portion and the bottom portion define an inductive area. At least one control element may be disposed in the capacitive area. At least one control element may be disposed in the inductive area. The at least one control element may be coupled to the top portion and to the middle portion. The at least one control element may be coupled to the middle portion and to the bottom portion. The at least one control element may be disposed to couple the top portion to the bottom portion. The at least one control element may be disposed to couple the bottom portion to the middle portion. The one or more control element may comprise a switch. The one or more control element may exhibit active capacitive or inductive characteristics. The one or more control element may comprise a transistor device. The one or more control element may comprise a FET device. The one or more control element may comprise a MEMs device. The device may further comprise a wireless communications device, a feed point, and a ground point; wherein the wireless communications device is coupled to the antenna through the feed point and the ground point.

In one embodiment an antenna comprises a ground plane; a first conductor having a first length extending generally longitudinally above the ground plane and having a first end electrically connected to the ground plane at a first location; a second conductor having a second length extending generally longitudinally above the ground plane, the second conductor having a first end electrically connected to the ground plane at a second location; an antenna feed coupled to the first conductor; and a first active component, the first active component comprising a control input, wherein an input to the control input enables characteristics of the antenna to be configured. The first and second conductors may overlap to form a gap, wherein the first active component is disposed in the gap. The first conductor or the second conductor may comprise the first active component. The first active component may be disposed between the second conductor and the ground plane. The first active component may disposed between the first conductor and the ground plane. The first active component may be disposed between the feed and the ground plane. The antenna may further comprise a first stub coupled to the feed. The first stub may comprise the first active component. The first active component may be disposed between the first stub and the ground plane. The antenna may further comprise a second stub and a second active component, wherein the first stub comprises the first active component, and wherein the second active component is coupled between the second stub and the ground plane.

In one embodiment a device may comprise a ground plane, the ground plane comprising a first side and a second side; a first capacitively loaded dipole antenna; and a second capacitively loaded dipole antenna, wherein the first antenna is coupled to a first side of the ground plane, and wherein the second antenna is coupled to a second side of the ground plane. The device may further comprise a first active component, the first active component comprising a first control input, wherein an input to the first control input enables characteristics of the first antenna to be configured; and a second active component, the second active component comprising a second control input, wherein an input to the second control input enables characteristics of the second antenna to be configured.

In one embodiment a capacitively loaded dipole antenna may comprise control means for actively controlling characteristics of the antenna.

In one embodiment a method for actively controlling characteristics of a capacitively loaded dipole antenna may comprise the steps of providing a capacitively loaded dipole antenna; providing a control element, the control element coupled to the antenna; providing an input to the control element; and controlling the characteristics of the antenna with the input.

Other embodiments are also within the scope of the invention and should be limited only by the claims that follow.

DETAILED DESCRIPTION OF THE INVENTION

Figure 1:
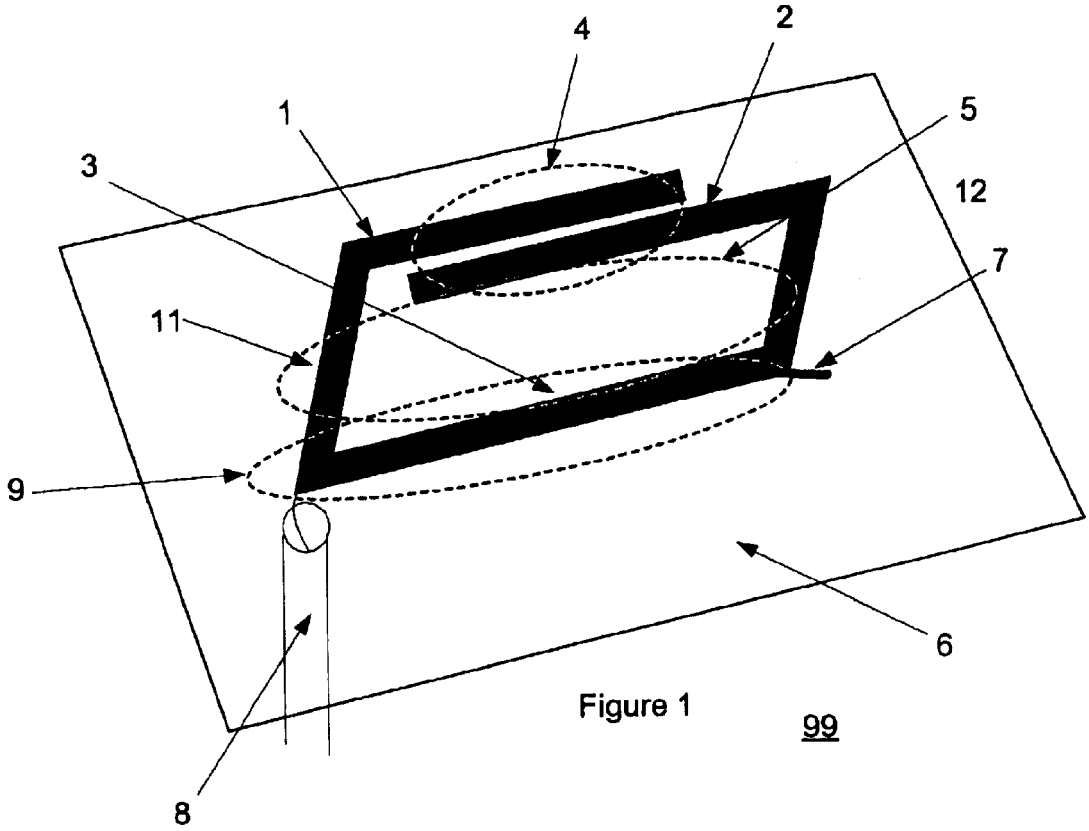
FIG. 1 illustrates a three-dimensional view of a capacitively loaded magnetic dipole.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Different embodiments of the present invention provide an antenna that may be actively changed or configured, with resultant small or large changes in characteristics of the antenna being achieved.

One characteristic that is configurable is resonant frequency. In one embodiment, a frequency shift in the resonant frequency of the antenna can be actively induced, for example, to follow a spread spectrum hopping frequency (Bluetooth, Home-RF, etc.,). The present invention provides a very small and highly isolated antenna that covers a few channels at a time, with the ability to track hopping frequencies quickly, improving the overall system performance.

In one embodiment, an antenna is provided with frequency switching capability that may be linked to a particular user, device, or system defined operating mode. Mode changes are facilitated by active real time configuration and optimization of an antennas characteristics, for example as when switching from a 800 MHz AMPS/CDMA band to a 1900 MHz CDMA band or from a 800/1900 MHz US band to a 900/1800 MHz GSM Europe and Asia band.

In one embodiment, the present invention comprises a configurable antenna that provides a frequency switching solution that is able to cover multiple frequency bands, either independently or at the same time.

In one embodiment, comprises a software-defined antenna for use in a software defined device. The device may comprise a wireless communications device, which may be fixed or mobile. Examples of other wireless communications devices within the scope of the present invention include cell phones, PDAs, and other like handheld devices.

Communication devices and antennas operating in one or more of frequency bands used for wireless communication devices (450 MHz, 800 MHz, 900 MHz, 1.575 GHz, 1.8 GHz, 1.9 GHz, 2 GHz. 2.5 GHz, 5 GHz, . . . ) are considered to be within the scope of the invention. Other frequency bands are also considered to be within the scope of the present invention.

The present invention provides the ability to optimize antenna transmission characteristics in a network, including radiated power and channel characteristics.

In one or more embodiment, channel optimization may be achieved by providing a beam switching, beam steering, space diversity, and/or multiple input-multiple output antenna design. Channel optimization may be achieved by either a single element antenna with configurable radiation pattern directions or by an antenna comprising multiple elements. The independence between different received paths is an important characteristic to be considered in antenna design. The present invention provides reduced coupling between multiple antennas, reducing correlation between channels.

The antenna design of the present invention may also be used when considering radiated power optimization. In one embodiment, an antenna is provided that may direct the antenna near-field away from disturbances and absorbers in real time by optimizing antenna matching and near-field radiation characteristics. This is particularly important in handset and other handheld device designs, which may interact with human bodies (hands, heads, hips, . . . ). In one embodiment, wherein one antenna is used in a communications device, input impedance may be actively optimized (control of the reflected signal, for example). In one embodiment where a device comprises multiple antennas, each antenna may be optimized actively and in real time.

Figure 2:
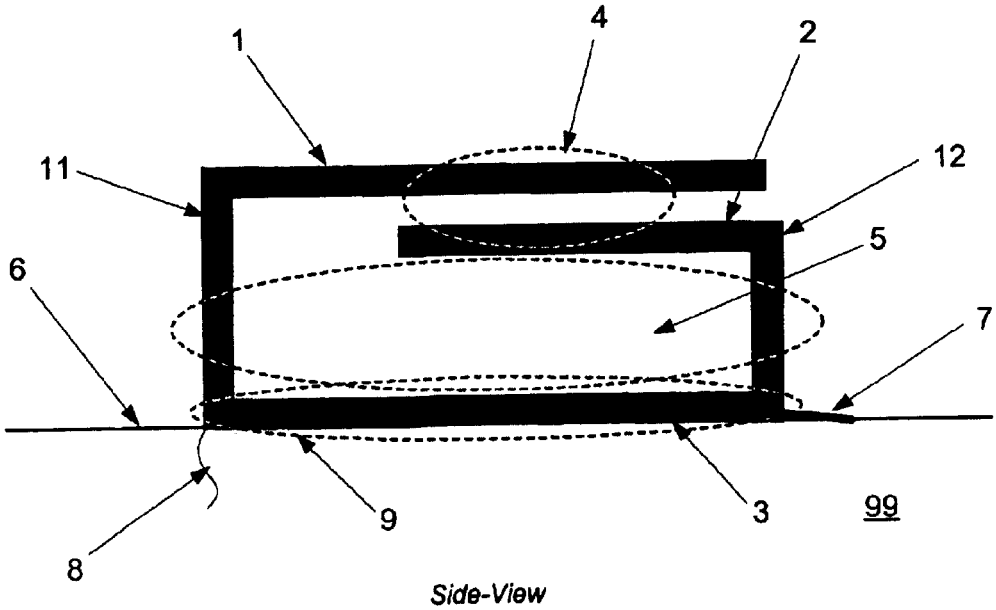
FIG. 2 illustrates a side-view of a capacitively loaded magnetic dipole.

FIGS. 1 and 2 illustrate a respective three-dimensional view and a side view of an embodiment of a capacitively loaded magnetic dipole antenna (99). In one embodiment, the antenna (99) comprises a top (1), a middle (2), and a bottom (3) portion. The top (1) portion is coupled to bottom portion (3), and the bottom portion (3) is coupled to the middle portion (2). In one embodiment, the top portion (1) is coupled to the bottom portion (3) by a portion (11), and the bottom portion (3) is coupled to middle portion (2) by a portion (12). In one embodiment, the portion (11) and the portion (12) are generally vertical portions and generally parallel to each other, and the portions (1), (2), and (3) are generally horizontal portions and generally parallel to each other. It is understood, however, that the present invention is not limited to the illustrated embodiment, as in other embodiments the portions (1), (2), (3), (11), and/or (12) may comprise other geometries. For example, top portion (1) may be coupled to bottom portion (3) and bottom portion may be coupled to middle portion (2) such that one or more of the portions are generally in non-parallel and non-horizontal relationships. In embodiments that utilize a portion (11) and a portion (12), non-parallel and/or non-vertical geometries of portion (11) and (12) are also within the scope of the present invention. In one embodiment, portions (1), (2), (3), (11), and (12) may comprise conductors. In one embodiment, the portions (1), (2), (3), (11), and (12) may comprise conductive plate structures, wherein the plate structures of each portion are coupled and disposed along one or more plane. For example, in the embodiment of FIG. 1 and FIG. 2, plate portions are disposed and coupled along a plane that is vertical to a grounding plane (6). In another embodiment, plate portions may also be disposed and coupled along planes that are at right angles and/or parallel to the grounding plane (6). Thus, it is understood that the portions of antenna (99), as well as the portions of other antennas described herein, may comprise other geometries and other geometric structures and yet remain within the scope of the present invention.

In one embodiment, the bottom portion (3) is attached to a grounding plane (6) at a grounding point (7), and bottom portion (3) is powered through a feedline (8). The antenna (99) of FIGS. 1 and 2 may be modeled as an LC circuit, with a capacitance (C) that corresponds to a fringing capacitance that exists across the gap defined generally by top portion (1) and middle portion (2), indicated generally as area (4), and with an inductance (L) that corresponds to an inductance that exists in an area indicated generally as area (5) and that is generally bounded by the middle portion (2) and the bottom portion (3). As will be understood with reference to the foregoing Description and Figures, the geometrical relationships of one or more portions in the capacitive area (4) may be utilized to effectuate large changes in the resonant frequency of the antenna (99), and the geometrical relationships between one or more portions in the inductive area (5) may be used to effectuate medium frequency changes. As welt, geometrical relationships between one or more portions in a feed area (9) may be utilized to effectuate small frequency changes. The areas (4), (5), and (9) may also be utilized for input impedance optimization. The structures and portions of the capacitively loaded magnetic dipole antenna illustrated in FIGS. 1 and 2 are further described in commonly assigned U.S. patent application Ser. No. 09/892,928, filed on Jun. 26, 2001, entitled "Multi Frequency Antenna Structure and Methods Reusing the Volume of an Antenna" by L. Desclos et al., which is incorporated herein by reference.

Figure 3A:
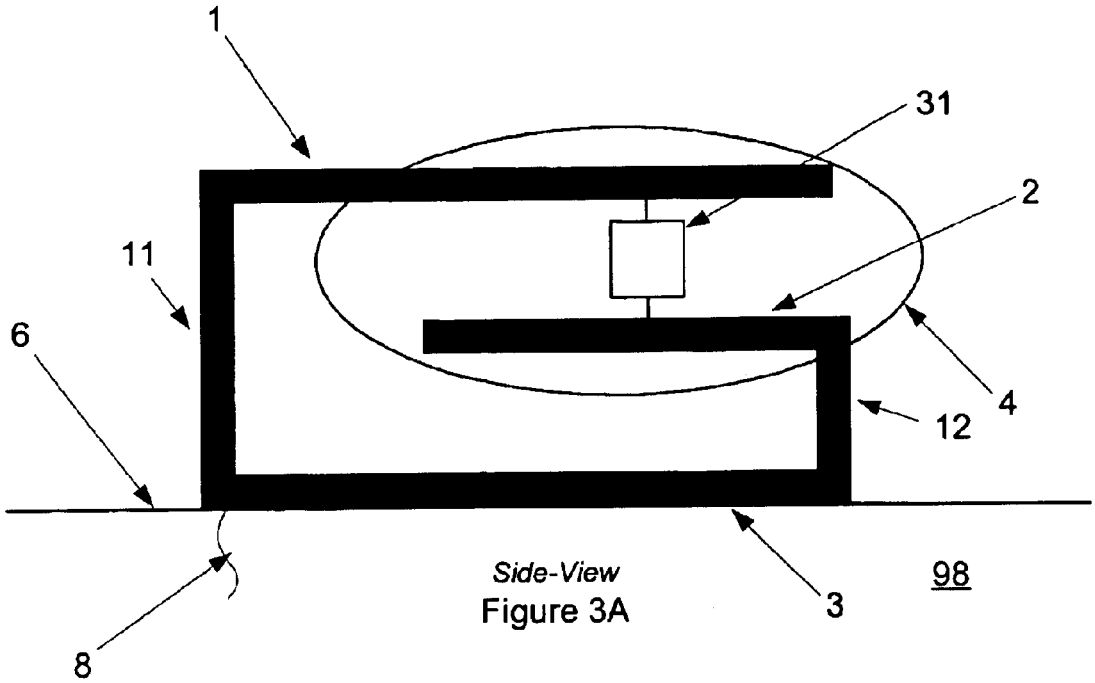
FIG. 3A illustrates a side-view of one embodiment of a capacitively loaded magnetic dipole wherein a control element (31) has been included in area (4).

FIG. 3A illustrates a side-view of a capacitively loaded magnetic dipole antenna (98), wherein a control element (31) is disposed generally in area (4). In the illustrated embodiment, control element (31) is electrically coupled at one end to top portion (1) and at another end to middle portion (2). In one embodiment, control element (31) comprises a device that may exhibit ON-OFF and/or actively controllable capacitive/inductive characteristics. In one embodiment, control element (31) may comprise a transistor device, a FET device, a MEMs device, or other suitable control element or circuit capable of exhibiting ON-OFF and/or actively controllable capacitive/inductive characteristics. It is identified that control element (31), as well as other control elements described further herein, may be implemented by those of ordinary skill in the art and, thus, control element (31) is described herein only in the detail necessary to enable one of such skill to implement the present invention. In one embodiment wherein the control element (31) comprises a switch with ON characteristics, the capacitance in area (4) is short-circuited, and antenna (98) may be switched off, no energy is radiated. In one embodiment, wherein the capacitance of the control element (31) may be actively changed, for example, by a control input to a connection of a FET device or circuit connected between top portion (1) and middle portion (2), the control element (31) will be understood by those skilled in the art as capable of acting generally in parallel with the fringing capacitance of area (4). It has been identified that the resulting capacitance of the control element (31) and the fringing capacitance may be varied to change the LC characteristics of antenna (98) or, equivalently, to vary the resonant frequency of the antenna (98) over a wide range of frequencies.

Figure 3B:
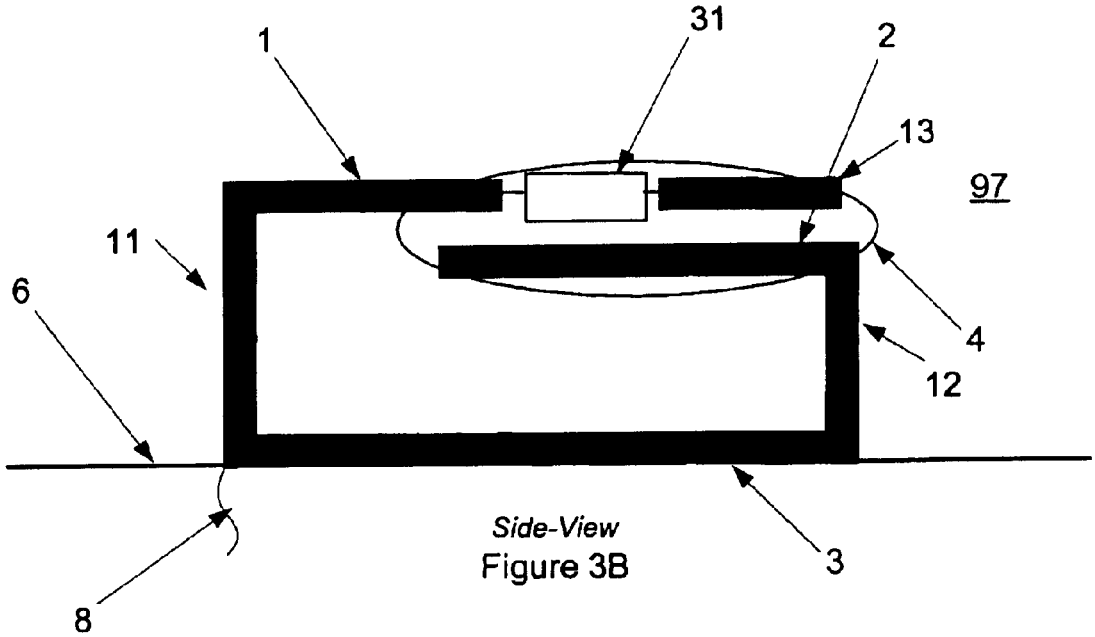
FIG. 3B illustrates a side-view of one embodiment of a capacitively loaded magnetic dipole where a control element (31) has been included in area (4).

FIG. 3B illustrates a side-view of a capacitively loaded magnetic dipole antenna (97), wherein a control element (31) is disposed generally in area (4). In the illustrated embodiment, control element (31) is electrically coupled at one end to top portion (1) and at another end to a tip portion. In one embodiment, control element (31) comprises a device that may exhibit ON-OFF and/or actively controllable capacitive/inductive characteristics. In one embodiment, control element (31) may comprise a transistor device, a FET device, a MEMs device, or other suitable control element. In one embodiment, wherein the control element (31) electrically couples or decouples the tip portion (13) from the top portion (1), for example as by the ON characteristics of a switch, the length of top portion (1) of antenna (97) may be increased or decreased such that the capacitance in area (4) may be changed to actively change the resonant frequency of antenna (97) from one resonant frequency to another resonant frequency. In one embodiment, wherein the capacitance of the control element (31) may be actively changed, for example, by a control input of a FET device or circuit, the control element (31) will be understood by those skilled in the art as capable of acting generally in series with the fringing capacitance of area (4). It has been identified that the resulting capacitance may be varied to actively change the LC characteristics of antenna (97) or, equivalently, to vary the resonant frequency of the antenna (98) over a wide range of frequencies.

Figure 4A:
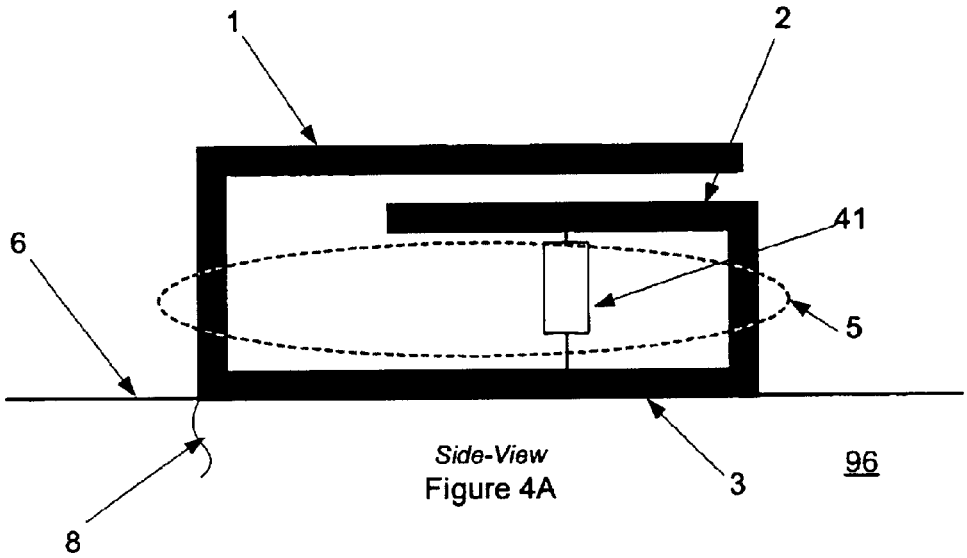
FIG. 4A illustrates a side-view of one embodiment of a capacitively loaded magnetic dipole where a control element (41) has been included in area (5).

FIG. 4A illustrates a side-view of a capacitively loaded magnetic dipole antenna (96), wherein a control element (41) is disposed generally in area (5). In the illustrated embodiment, control element (41) is electrically coupled at one end to bottom portion (3) and at another end to middle portion (2). In one embodiment, control element (41) comprises a device that may exhibit ON-OFF and/or actively controllable capacitive or inductive characteristics. In one embodiment, control element (41) may comprise a transistor device, a FET device, a MEMs device, or other suitable control element or circuit. In one embodiment wherein the control element (41) exhibits ON characteristics, the inductance in area (4) is short-circuited and antenna (96) may be switched off. In one embodiment, wherein the inductance of the control element (31) may be actively changed, for example, by a control input to a device or circuit connected between the bottom portion (3) and the middle portion (2). An example of a device or circuit that enables active control of inductance is presented in "Broad band monolithic microwave active inductor and its application to miniaturise wide band amplifiers" presented in IEEE Trans. Microwave Theory Tech, vol. 36, pp. 1020–1924, Dec. 1988 by S. Hara, T. Tokumitsu, T. Tanaka, and M. Aikawa, which is incorporated herein by reference. Control element (41) will be understood by those skilled in the art as capable of acting as an inductor generally in parallel with the inductance of area (5). It has been identified that the resulting inductance may be varied to change the LC characteristics of antenna (96) or, equivalently, to vary the resonant frequency of the antenna (96) over a medium range of frequencies.

Figure 4B:
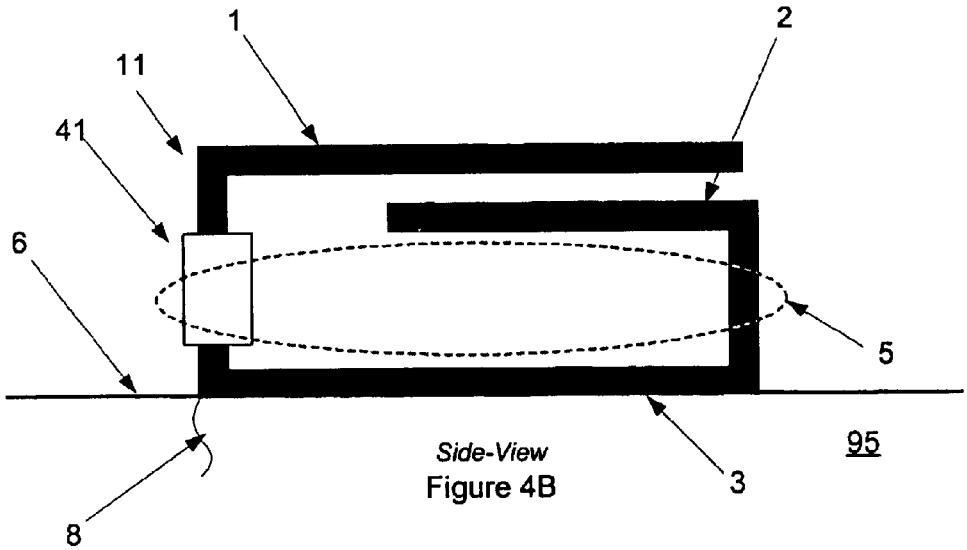
FIG. 4B illustrates a side-view of one embodiment of a capacitively loaded magnetic dipole where a control element (41) has been included in area (5).

FIG. 4B illustrates a side-view of a capacitively loaded magnetic dipole antenna (95), wherein a control element (41) is disposed generally in area (5) at a break in portion (11) and electrically coupled at one end to top portion (1) and at another end to bottom portion (3). In one embodiment, control element (41) comprises a device that may exhibit ON-OFF and/or actively controllable capacitive or inductive characteristics. In one embodiment, control element (41) may comprise a transistor device, a FET device, a MEMs device, or other suitable control element or circuit. In one embodiment, wherein the control element (41) exhibits OFF characteristics, it has been identified that the LC characteristics of the antenna (95) may be changed such that antenna (95) operates at a frequency 10 times higher than the frequency at which the antenna operates with a control element that exhibits ON characteristics. In one embodiment, wherein the inductance of the control element (41) may be actively controlled, it has been identified that the resonant frequency of the antenna (95) may be varied quickly over a narrow bandwidth.

Figure 4C:
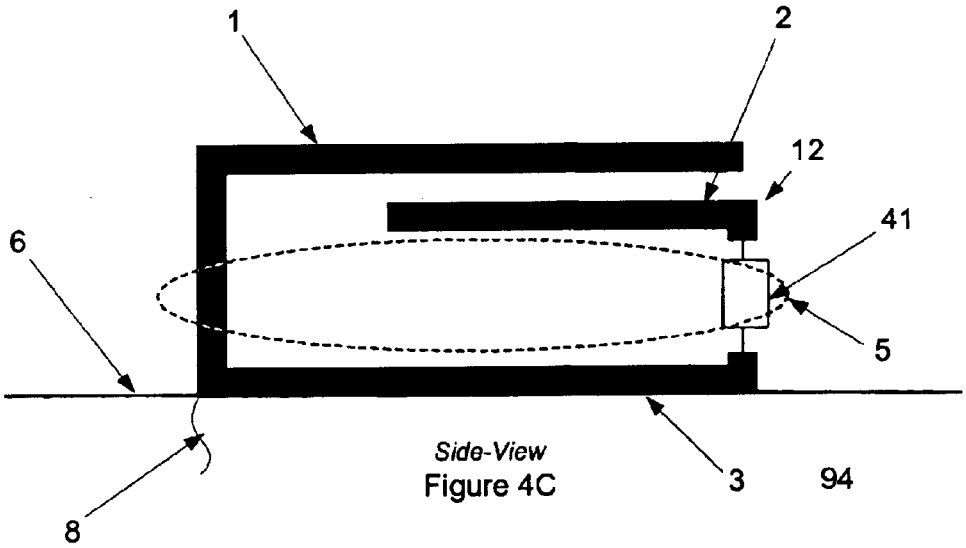
FIG. 4C illustrates a side-view of one embodiment of a capacitively loaded magnetic dipole where a control element (41) has been included in area (5).

FIG. 4C illustrates a side-view of a capacitively loaded magnetic dipole antenna (94), wherein a control element (41) is disposed generally in area (5) and electrically coupled at a break in portion (12) at one end to a middle portion (2) and at another end to bottom portion (3). In one embodiment, control element (41) comprises a device that may exhibit ON-OFF and/or actively controllable capacitive or inductive characteristics. In one embodiment, control element (41) may comprise a transistor device, a FET device, a MEMs device, or other suitable control element or circuit. In one embodiment, wherein the control element (41) exhibits OFF characteristics, it has been identified that the LC characteristics of the antenna (94) may be changed such that antenna (94) operates at a frequency 10 times higher than the frequency at which the antenna operates with a control element that exhibits ON characteristics. In one embodiment, wherein the inductance of the control element (41) may be actively controlled, it has been identified that the resonant frequency of the antenna (94) may be changed quickly over a narrow bandwidth.

Figure 5A:
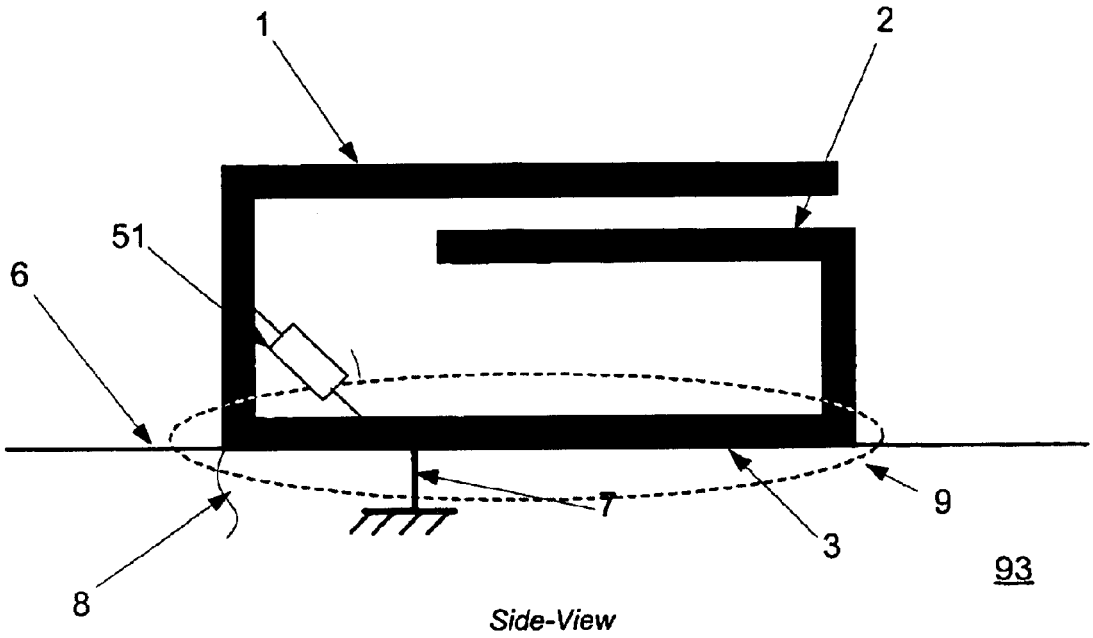
FIG. 5A illustrates a side-view of one embodiment of a capacitively loaded magnetic dipole where a control element (51) has been included in area (9).

FIG. 5A illustrates a side-view of a capacitively loaded magnetic dipole antenna (93), wherein a control element (51) is disposed generally in area (9) and coupled at one end generally at feed point (8) and at another end along the bottom portion (3) and along grounding plane (6). In one embodiment, control element (51) comprises a device that may exhibit ON-OFF and/or actively controllable capacitive or inductive characteristics. In one embodiment, control element (51) may comprise a transistor device, a FET device, a MEMs device, or other suitable control element or circuit. In one embodiment, wherein the control element (51) exhibits ON characteristics, the antenna (93) is short-circuited and no power is either radiated or received by the antenna (93). With a control element exhibiting OFF characteristics, the antenna (93) may operate normally. In one embodiment, wherein the inductance and/or capacitance of the control element (51) may be controlled, it has been identified that it is possible to control the input impedance of the antenna such that the input impedance may be adjusted in order to maintain the best antenna characteristics while the antenna's environment is changing.

Figure 5B:
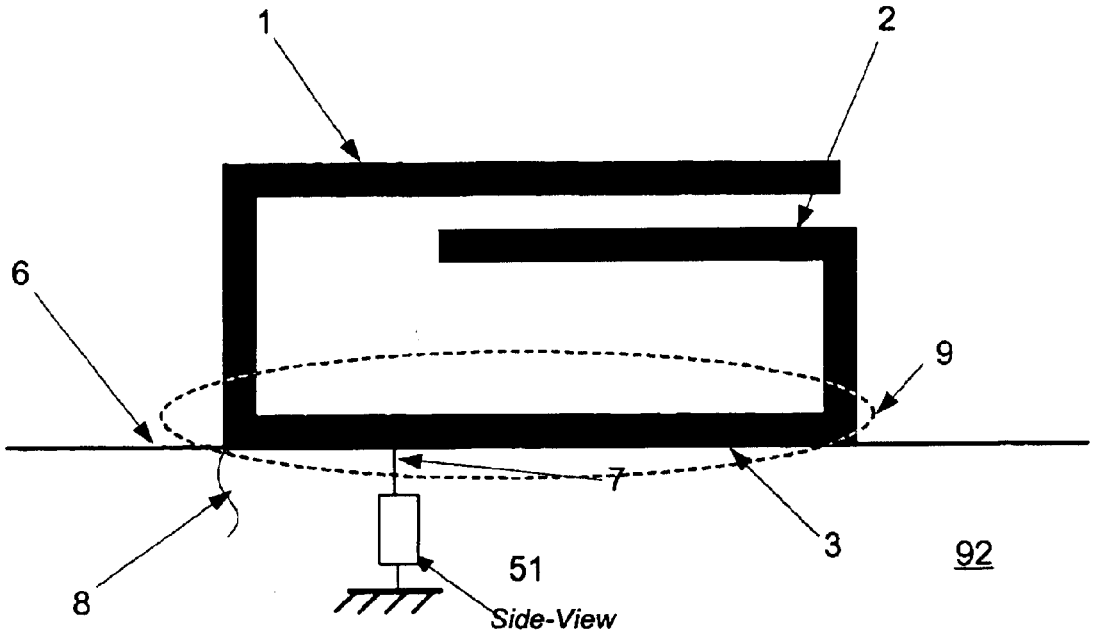
FIG. 5B illustrates a side-view of one embodiment of a capacitively loaded magnetic dipole where a control element (51) has been included in area (9).

FIG. 5B illustrates a side-view of a capacitively loaded magnetic dipole antenna (92), wherein a control element (51) is disposed generally in feed area (9) and coupled at one end to bottom portion (3) and coupled at another end at a ground point. In one embodiment, wherein the control element exhibits ON characteristics, the antenna (92) operates normally, whereas with OFF characteristics exhibited by the control element, the antenna acts as an open circuit. In one embodiment, wherein the inductance and capacitance of the control element (51) may be controlled, it has been identified that it is possible to control the input impedance of the antenna. In one embodiment, the input impedance may thus be adjusted while the antenna environment is changing in order to maintain the best antenna characteristics.

Figure 6A:
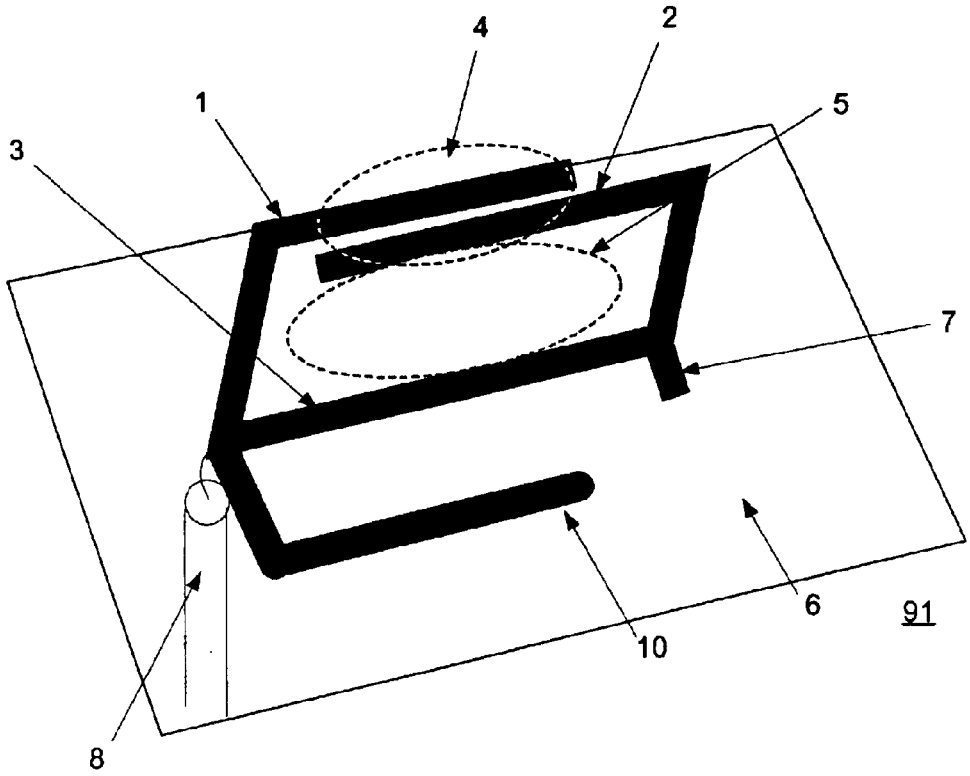
FIG. 6A illustrates a three-dimensional view of one embodiment of a capacitively loaded magnetic dipole, comprising a capacitive area (4), and an inductive area (5) on which a stub (10) has been added along a feed area (9).

FIG. 6A illustrates a three-dimensional view of a capacitively loaded magnetic dipole antenna (91) comprising a capacitive (4) and an inductive (5) area, and further including a first stub (10) electrically coupled to a feedline (8). The first stub (10) may be used to increase the bandwidth of the capacitively loaded magnetic dipole antenna (91) and/or to create a second resonance to increase the overall usable bandwidth of the antenna (91).

Figure 6B:
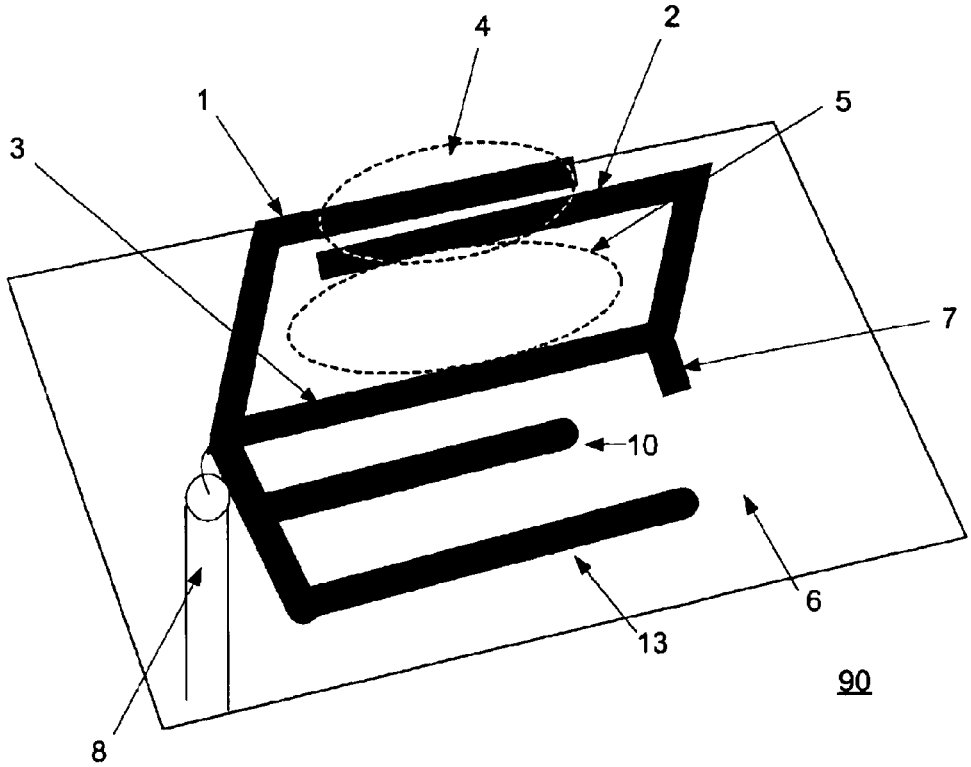
FIG. 6B illustrates a three-dimensional view of one embodiment of a capacitively loaded magnetic dipole, comprising a capacitive area (4), and an inductive area (5) on which a stub (10) has been added along a feed area (9).

FIG. 6B illustrates a three-dimensional view of a capacitively loaded magnetic dipole antenna (90) comprising a capacitive (4) and an inductive (5) area, and further including a first stub (10) coupled to a feedline (8), and a second stub (13) electrically coupled to the feedline (8).

Figure 7A:
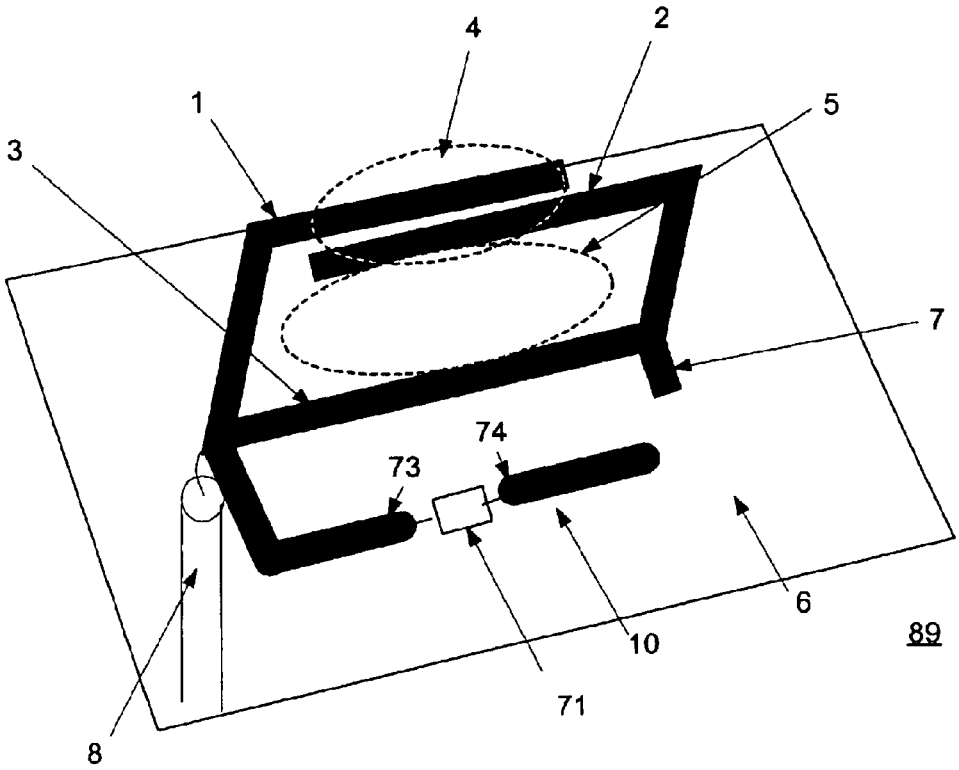
FIG. 7A illustrates a three-dimensional view of one embodiment of a capacitively loaded magnetic dipole, comprising a capacitive area (4), an inductive area (5), and a stub (10) along which is placed a control element (71).

FIG. 7A illustrates a three-dimensional view of a capacitively loaded magnetic dipole antenna (89) comprising a capacitive area (4), an inductive (5) area, and a stub (10). In one embodiment, the electrical continuity of stub (10) is interrupted by electrical connection of a control element (71), which as indicated in FIG. 7A is disposed along a break in stub (10) between points (73) and (74). In one embodiment, control element (71) comprises a device that may exhibit ON-OFF and/or actively controllable capacitive or inductive characteristics. In one embodiment, control element (71) may comprise a transistor device, a FET device, a MEMs device, or other suitable control element or circuit. In one embodiment, with a control element (71) that exhibits ON characteristics, the entire length of stub (10) acts to influence the antenna (89) characteristics. With the control element (71) exhibiting OFF characteristics, only the part of the stub making electrical contact with the antenna acts to affect the LC circuit of the antenna (89). In one embodiment, it has been identified that by controlling the inductance and capacitance of control element (71) it is possible to achieve a controllable variation of frequency or bandwidth, or to effectuate impedance matching of the antenna (89).

Figure 7B:
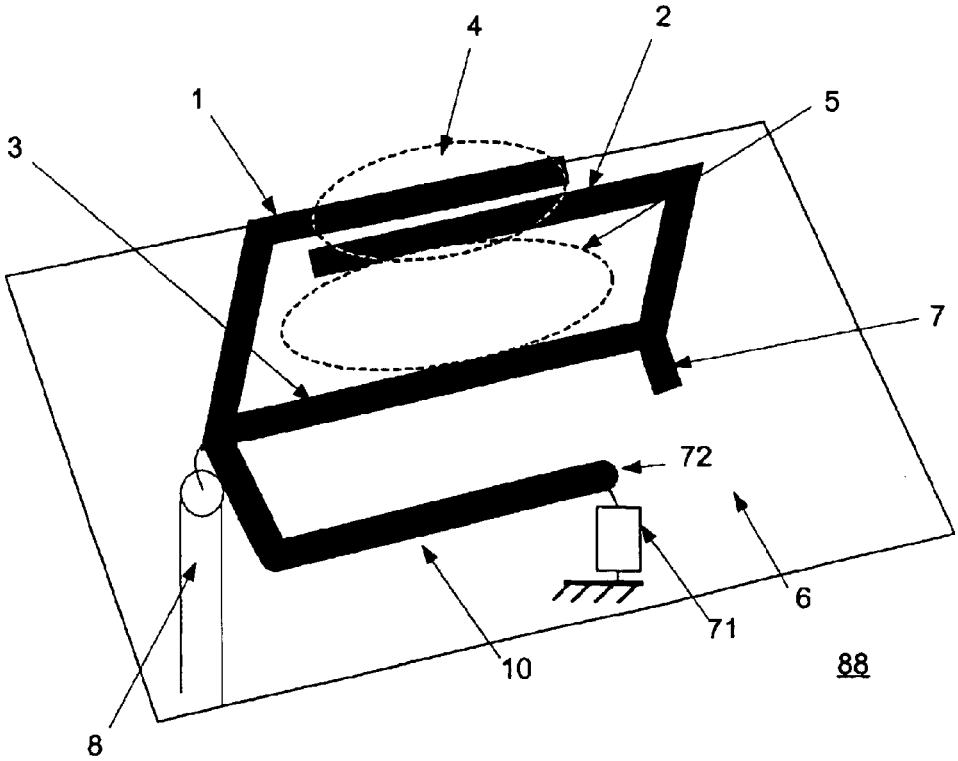
FIG. 7B illustrates a three-dimensional view of one embodiment of a capacitively loaded magnetic dipole, comprising a capacitive area (4), an inductive area (5), and a stub (10) at the tip of which is placed a control element (71).

FIG. 7B illustrates a three-dimensional view of a capacitively loaded magnetic dipole antenna (88) comprising a capacitive (4) area, an inductive (5) area, and a stub (10). As illustrated in FIG. 7B, one end of a control element (71) is electrically coupled to stub (10) at its end portion (72) and another end of stub (10) is coupled to a ground point. In one embodiment, control element (71) comprises a device that may exhibit ON-OFF and/or actively controllable capacitive or inductive characteristics. In one embodiment, control element (71) may comprise a transistor device, a FET device, a MEMs device, or other suitable control element or circuit. In one embodiment, wherein control element (71) exhibits ON characteristics, stub (10) is short-circuited. With the control element (71) comprising OFF characteristics, the stub (10) may act to influence the operating characteristics of antenna (88). In one embodiment wherein inductance and capacitance of the control element (71) may be actively controlled, it has been identified that it is possible to have a continuous variation of resonance frequency or bandwidth.

Figure 7C:
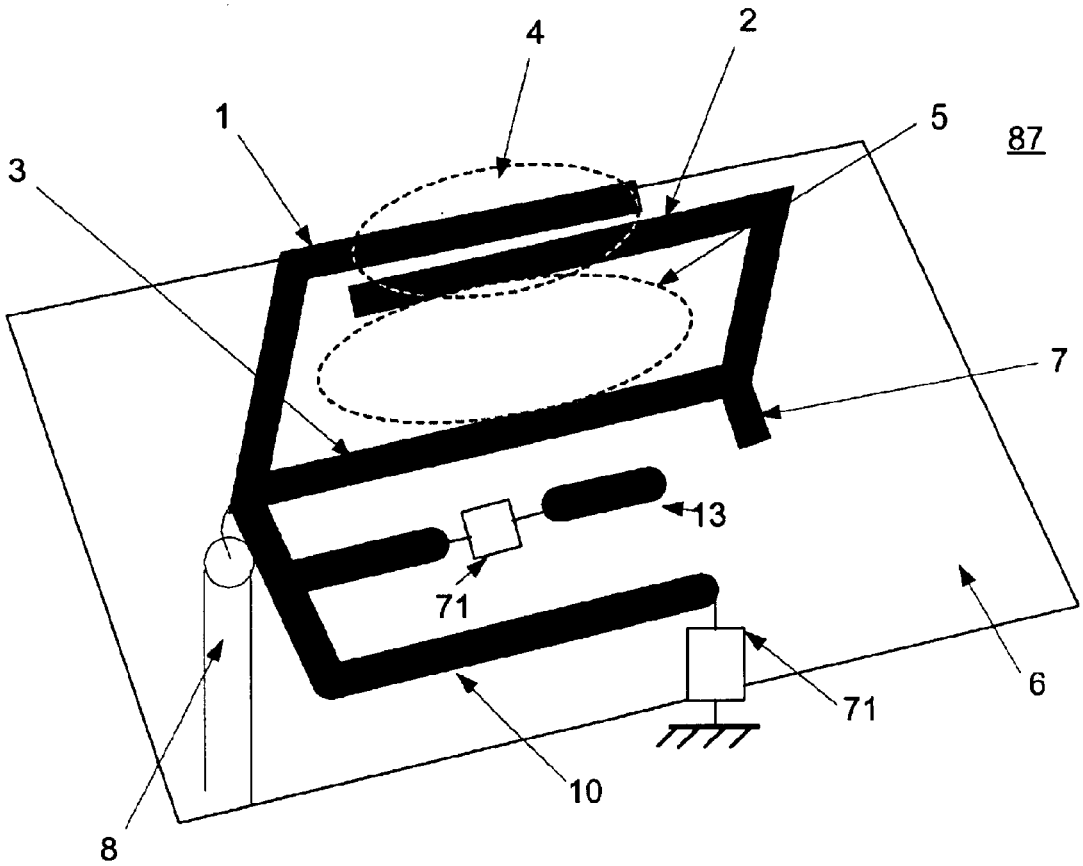
FIG. 7C illustrates a three-dimensional view of one embodiment of a capacitively loaded magnetic dipole, comprising a capacitive area (4), an inductive area (5), and multiple stubs (10) with control elements (71) placed on them.

FIG. 7C illustrates a three-dimensional view of a capacitively loaded magnetic dipole antenna (87), comprising a capacitive (4) area, an inductive (5) area, a first stub (10), and a second stub (13). In one embodiment, stub (10) and stub (13) may incorporate respective control elements (71) as referenced in FIGS. 7A and 7B, to effectuate changes in the LC characteristics of antenna (87) in accordance with descriptions previously presented herein.

Figure 8:
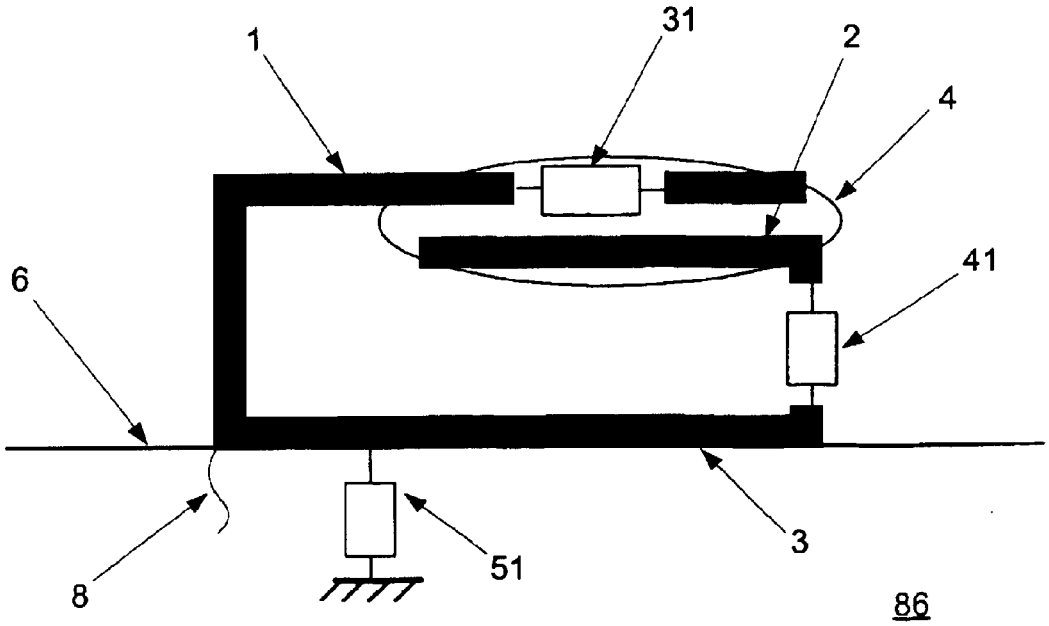
FIG. 8 illustrates a three dimensional view of one embodiment of a capacitively loaded magnetic dipole, comprising a capacitive area (4), an inductive area (5), and a stub (10).

FIG. 8 illustrates a side view of a capacitively loaded magnetic dipole antenna (86) comprising a capacitive (4) area, an inductive (5) area, and a stub (10) (not visible in side view). In one embodiment, a control element (31) may be disposed in upper portion (1) to effectuate changes in the operating frequency of the antenna (86), for example, to effectuate changes from a 800/1900 MHz US frequency band to a 900/1900 MHz GSM Europe and Asia frequency band. In one embodiment, a second control element (41) may be disposed in portion (12) to effectuate changes in the resonant frequency of antenna (86) over a range of frequencies. In one embodiment, a control element (51) may be disposed between lower portion (3) and a ground point to effectuate control of the input impedance as a function of loading of the antenna (86). A control feedback signal for effectuating control may be obtained by monitoring the quality of transmissions emanating from the antenna (86). In one embodiment, a control element may be disposed in the stub (10) to effectuate control of a second resonance corresponding to a transmitting band.

It is identified that one way to improve the transmission quality of an antenna is to switch an antenna's beam direction or to steer an antenna's beam. In one embodiment, beam switching may be obtained with two capacitively loaded magnetic dipoles that are switched ON or OFF using control elements as described herein.

Figure 9A:
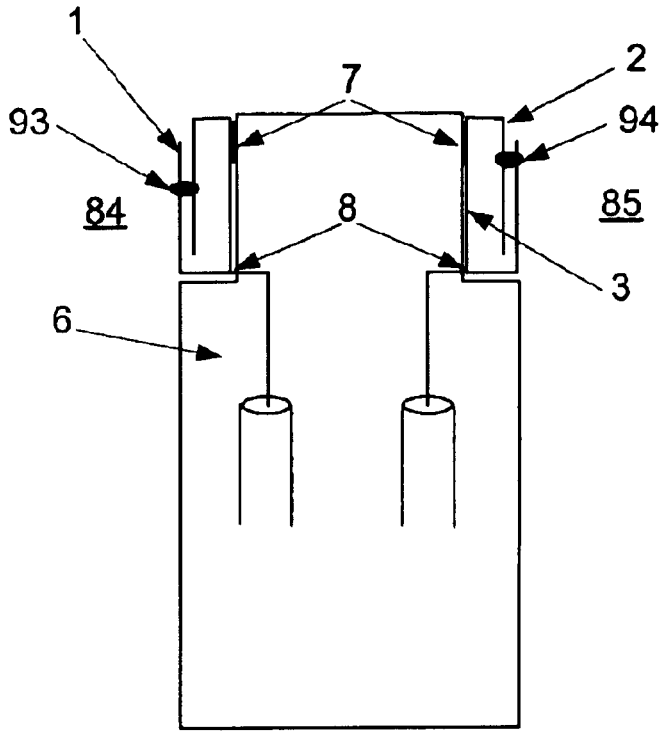
FIG. 9A illustrates a top view of one embodiment of two capacitively loaded magnetic dipoles (91, 92) flush and parallel on both sides of a ground plane with each of the radiating elements including a control element (93, 94).

FIG. 9A illustrates a top view of two capacitively loaded magnetic dipole antennas (84, 85). In one embodiment, each antenna is opposingly disposed flush and parallel to a ground plane (6). In one embodiment, each antenna (84, 85) may comprise respective control elements (93, 94). By controlling each control element (93, 94) to exhibit ON-OFF characteristics, respective radiating elements comprising a top portion (1) of a respective antenna can be turned OFF or ON to effectuate utilization of one antenna or the other. With both control elements (93, 94) exhibiting OFF characteristics, both antennas (84, 85) may be utilized to provide a wider radiation pattern.

Figure 9B:
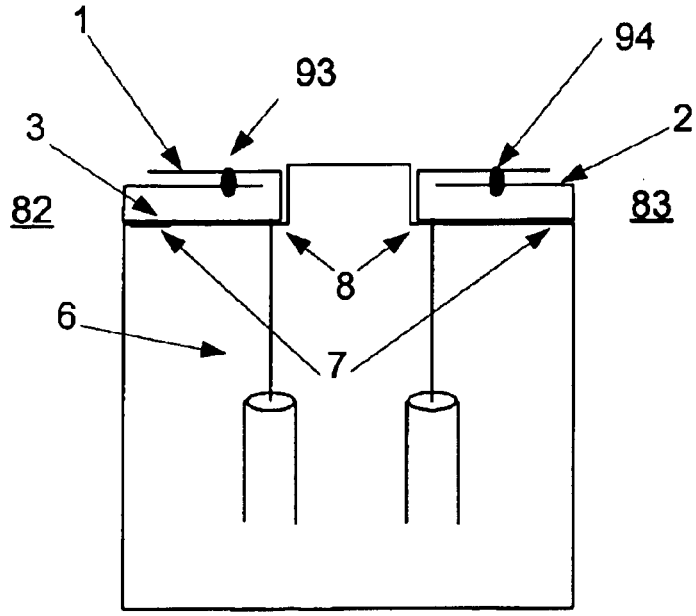
FIG. 9B illustrates a top view of one embodiment of two capacitively loaded magnetic dipoles (91, 92) flush back to back on both sides of a ground plane with each of the radiating elements including a control element (93, 94).

FIG. 9B illustrates a top view of two capacitively loaded magnetic dipole antennas (82, 83). In one embodiment, each antenna is opposingly disposed flush and back to back on both sides of a ground plane (6). In one embodiment, each antenna comprises respective control elements (93, 94). By controlling each control element (93, 94) to exhibit ON-OFF characteristics, respective radiating elements comprising a top portion (1) of a respective antenna can be turned OFF or ON in order to utilize one antenna or the other. Alternatively, if both control elements (93, 94) exhibit OFF characteristics, both antennas (82, 83) can be utilized to offer wider antenna coverage.

Figure 10A:
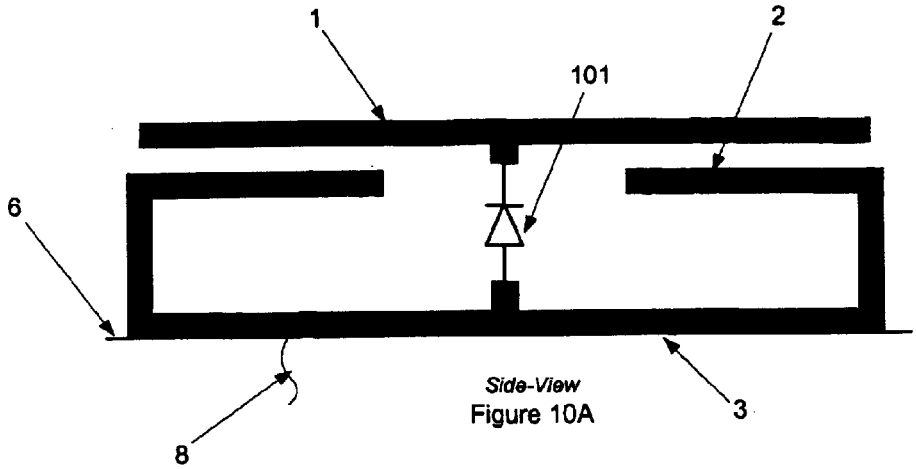
FIG. 10A illustrates one embodiment of two capacitively loaded magnetic dipoles back to back, sharing the connection from a top portion (1) to a bottom portion (3) wherein along the shared connection is a control element (101).

FIG. 10A illustrates two capacitively loaded magnetic dipoles coupled in a back to back configuration to comprise an antenna (81). In one embodiment, a top portion (1) of antenna (81) is coupled to a bottom portion (3) by a vertical portion that comprises a control element (101), which is electrically connected to top portion (1) at one end and to bottom portion (3) at another end. In one embodiment, wherein control element (101) exhibits ON characteristics, the antenna (81) LC characteristics are defined by parallel capacitance and inductance of generally defined by the capacitive (4) and inductive (5) areas. With a control element that exhibits OFF characteristics, it has been identified that antenna (81) resonates at a lower frequency and a wider area of coverage and bandwidth.

Figure 10B:
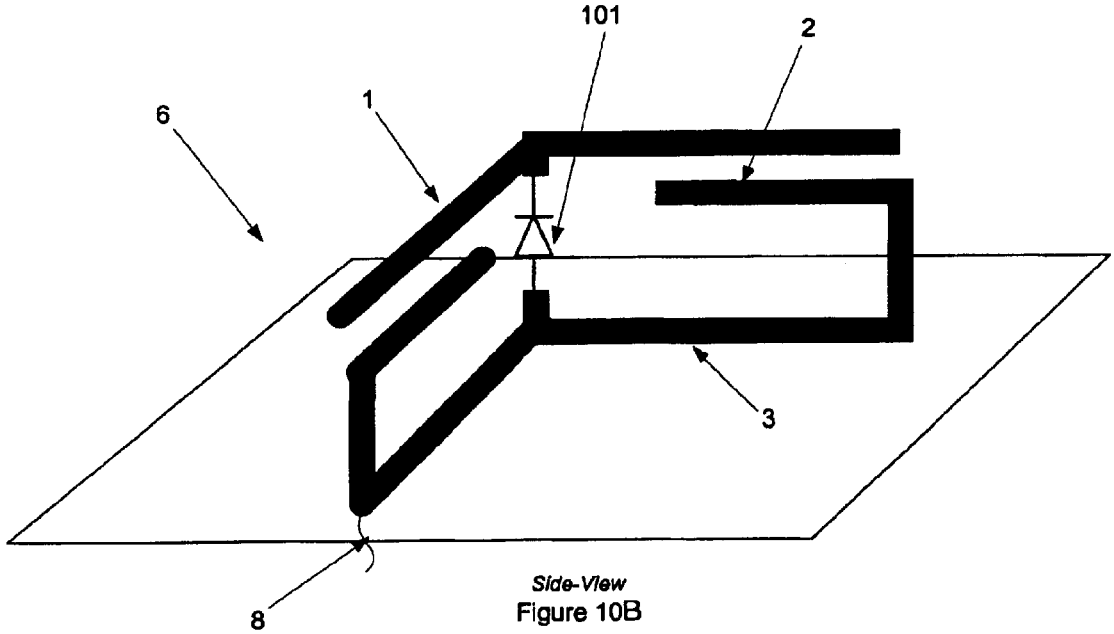
FIG. 10B illustrates one embodiment of two capacitively loaded magnetic dipoles sharing the connection from a top portion (1) to a bottom portion (3).

FIG. 10B illustrates another configuration of two capacitively loaded magnetic dipoles coupled to comprise an antenna (80). In one embodiment, a top portion (1) of antenna (81) is coupled to a bottom portion (3) by a vertical portion that comprises a control element (101), which is electrically connected to top portion (1) at one end and to bottom portion (3) at another end. In the illustrated embodiment, top radiating portions (1) of antenna (80) are orthogonal rather than in the same plane, which provides polarization diversity in the radiation pattern provided by the radiating portions.

Figure 11:
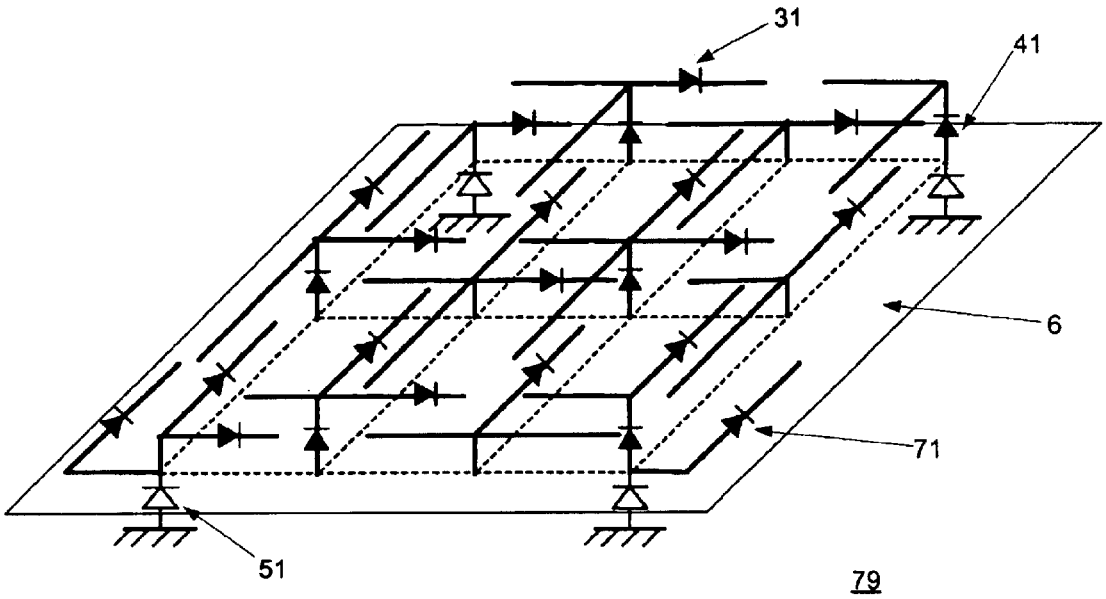
FIG. 11 illustrates a 3D structure comprising multiple capacitively loaded magnetic dipoles, sharing common areas with control elements placed in different areas.

FIG. 11 illustrates a 3D antenna (79) comprised of multiple capacitively loaded magnetic dipole antennas. In one embodiment, individual dipole antennas share common areas with one or more control elements placed in the capacitive area, inductive area, matching area, and/or stub area of one or more of the dipole structures, for example, control elements (31, 41, 51, 71). Such a complex structure effectuates coverage of multiple frequency bands and provides the most optimized solution in terms of input impedance, radiated power and beam direction. In one embodiment, multiple capacitively magnetic dipole antennas can be arranged to offer selection of a different configuration solutions in real time. For example, in one embodiment, wherein the human body influences reception or transmission of a wireless communications, one or more antennas could be actively substituted for other antennas to improve the real time reception or transmission of a communication.

It will be recognized the preceding description embodies an invention that may be practiced in other specific forms without departing from the spirit and essential characteristics of the disclosure. Thus, it is understood that the invention is not to be limited by the foregoing illustrative details, but rather is to be defined by the appended claims.

What is claimed is:

1. A device, comprising:

a ground plane, the ground plane comprising a first side and a second side;

a first capacitively loaded dipole antenna;

a second capacitively loaded dipole antenna, wherein the first antenna is coupled to a first side of the ground plane, and wherein the second antenna is coupled to a second side of the ground plane;

a first active component, the first active component comprising a first control input, wherein an input to the first control input enables characteristics of the first antenna to be configured; and a second active component, the second active component comprising a second control input, wherein an input to the second control input enables characteristics of the second antenna to be configured.

2. The device of claim 1, wherein the first capacitively loaded dipole antenna further comprises a plurality of portions and wherein the first active component in coupled to one or more of the plurality of portions.

3. The device of claim 2, wherein one or more of the plurality of portions device a capacitive area and wherein the first active component is disposed generally in the capacitive area.

4. The device of claim 2, wherein one or more of the plurality of portions define an inductive area, and wherein the first active component is disposed generally in the inductive area.

5. The device of claim 2, wherein one or more of the plurality of portions define a feed area, and wherein the first active component is disposed generally in the feed area.

6. The device of claim 2, wherein the plurality of portions further comprising a top portion, a middle portion, and a bottom portion, wherein the top portion is coupled to the bottom portion, the bottom portion is coupled to the middle portion, and the middle portion is disposed generally between the top portion and the bottom portion.

7. The device of claim 6, wherein the top portion and the middle portion generally define a capacitve area, wherein the middle portion and the bottom portion generally define an inductive area.

8. The device of claim 7, wherein the first active component is disposed in the capacitive area.

9. The device of claim 7, wherein the first active component is disposed in the inductive area.

10. The device of claim 7, wherein the first active component is coupled to the top portion and the middle portion.

11. The device of claim 7, wherein the first active component is coupled to the middle portion and the bottom portion.

12. The device of claim 7, wherein the first active component is disposed to couple to the top portion to the bottom portion.

13. The device of claim 7, wherein the first active component is disposed to couple the bottom portion to the middle portion.

14. The device of claim 1, wherein the first active component further comprises a switch.

15. The device of claim 1, wherein the first active component further exhibits active capacitive or inductive characteristics.

16. The device of claim 1, wherein the first active component further comprises an FET device.

17. The device of claim 1, wherein the first active component further comprises a MEMs device.

18. The device of claim 1, wherein the device further comprises a wireless communication device, a feed, and a ground, wherein the wireless communications device is coupled to the first capacitively loaded dipole antenna through the feed and the ground.

19. The device of claim 1, wherein the device further comprises a wireless communication device, a feed, and a ground, wherein the wireless communications device is coupled to the second capacitively loaded dipole antenna through the feed and the ground.

20. The device of claim 1, wherein the first capacitively loaded dipole antenna further comprises:

a ground plane;

a first conductor having a first length extending generally longitudinally above the ground plane and having a first end electrically connected to the ground plane at a first location;

a second conductor having a second length extending generally longitudinally above the ground plane, the second conductor having a first end electrically connected to the ground plane at a second location; and an antenna feed coupled to the first conductor.

21. The device of claim 20, wherein the first and second conductors overlap in an area to form a gap, wherein the first active component is disposed in the gap.

22. The device of claim 20, wherein the first conductor or the second conductor comprise the first active component.

23. The device of claim 20, wherein the first active component is disposed between the second conductor and the ground plane.

24. The device of claim 20, wherein the first active component is disposed between the antenna feed and the ground plane.

25. The device of claim 20, further comprising a first stub coupled to the antenna feed.

26. The device of claim 25, wherein the first stub comprises the first active component.

27. The device of claim 25, further comprising a second stub and a third active component, wherein the first stub comprises the first active component, and the third active component is coupled between the second stub and the ground plane.

* * * * *